United States Patent [19]

Rooney

[11] 4,300,320

[45] Nov. 17, 1981

[54] BRIDGE SECTION COMPOSITE AND METHOD OF FORMING SAME

[75] Inventor: Craig E. Rooney, Prairie Village, Kans.

[73] Assignee: Havens Steel Company, Kansas City, Mo.

[21] Appl. No.: 93,395

[22] Filed: Nov. 13, 1979

[51] Int. Cl.[3] ..... E04H 14/00

[52] U.S. Cl. ..... 52/173 R; 52/309.12; 52/334; 52/378; 52/454; 52/262; 14/73

[58] Field of Search ..... 52/174, 309.12, 334, 52/378, 414, 443, 723, 600, 335, 454, 309.17, 250, 612, 548, 173, 262; 14/73; 404/70, 71

[56] References Cited

U.S. PATENT DOCUMENTS

| | | | |
|---|---|---|---|
| 1,863,258 | 6/1932 | Tashjian | 52/723 X |
| 1,929,478 | 10/1933 | Bunker | 14/73 X |
| 2,091,750 | 8/1937 | Coddington | 52/612 X |
| 2,211,513 | 8/1940 | Nagin | 14/73 |
| 2,334,355 | 11/1943 | Russell . | |
| 2,921,354 | 5/1965 | Parkey et al. | 52/174 X |
| 3,066,771 | 12/1962 | Wolchuk . | |
| 3,103,025 | 9/1963 | Gassner et al. | 52/334 X |
| 3,110,049 | 11/1963 | Nagin | 14/73 |
| 3,181,187 | 5/1965 | Kahn | 52/378 X |
| 3,260,023 | 7/1966 | Nagin | 52/181 |
| 3,302,361 | 2/1967 | Oudheusden, Jr. et al. | 52/618 |
| 3,308,725 | 3/1967 | Nagin et al. | 94/4 |
| 3,377,462 | 4/1968 | Pfecschy | 404/71 X |
| 3,564,799 | 2/1971 | Hanson | 52/334 |
| 3,802,147 | 4/1974 | O'Konski | 52/454 X |
| 4,090,336 | 5/1978 | Carroll | 52/309.12 X |
| 4,129,917 | 12/1978 | Sivachenko et al. | 14/73 |
| 4,145,153 | 3/1979 | Fasullo et al. | 404/73 |
| 4,164,831 | 8/1979 | Messick et al. | 52/612 X |

OTHER PUBLICATIONS

Composite Construction in Steel & Concrete for Bridges & Buildings, Viest, Fountain, Singleton, 1958, pp. 42–45.

Design of Steel Structures, Wily & Sons, Inc., 1960, pp. 639, 642–643.

*Primary Examiner*—Price C. Faw, Jr.
*Assistant Examiner*—Carl D. Friedman
*Attorney, Agent, or Firm*—Schmidt, Johnson, Hovey & Williams

[57] ABSTRACT

A low cost, structurally superior bridge and fabrication method are described which take maximum advantage of the compressive strength of concrete, and the tensile strength of steel, to give a bridge structure having the lowest allowable depth-to-span ratio and good dead load/live load ratios, as well as minimum deflection under impacting, moving concentrated loads. The bridge is most preferably shop cast in sections which include lowermost, substantially planar structural metallic plates (e.g., 5/16" thick self-rusting steel) of length and width dimensions substantially equal to that of the sections; a separate layer of concrete is then composited to each plate, preferably by means of upstanding studs secured to the plate and embedded within the concrete. Monolithic bridge sections are thus formed which can be transported to the bridge site, erected and connected, typically by welding the respective section plates together at regular intervals. All necessary bridge sections are preferably cast simultaneously on a single bed, so that field construction of the bridge is facilitated and the sections have guaranteed match. It is estimated that bridge superstructures in accordance with the invention can be constructed for a cost significantly less than that of conventional bridge superstructure.

10 Claims, 13 Drawing Figures

BRIDGE SECTION COMPOSITE AND METHOD OF FORMING SAME

BACKGROUND OF THE INVENTION

1. Field of the Invention

The present invention is concerned with an improved, composited, short span bridge construction, and method of fabricating the same. More particularly, it is concerned with such a structure and method wherein use is made of structural metallic steel plates composited to concrete such that, after the bridge is erected, the concrete absorbs load-induced compressive forces, and the steel absorbs primary load-induced tensile forces in all planar directions; in this fashion, maximum advantage is taken of the strength characteristics of the materials forming the bridge superstructure without the necessity of embedding reinforcing steel with the concrete decking. In addition, with use of standard mill steel plate, and shop casting techniques, the cost of completed bridges in accordance with the invention is significantly lower than that of conventional designs.

2. Description of the Prior Art

The construction of modern day bridges, such as highway and railroad bridges, is subject to a number of constraints, principally arising from the necessity of adequately distributing and safely absorbing concentrated moving loads imposed thereon without excessive deflection. In the case of highway bridges, the recognition of this problem has led to promulgation of a plethora of rather stringent regulations. For example, one commonly applied code specifies that the completed bridge must be able to sustain, over each possible ten foot travelway within its width, a uniform load of 640 lbs. per lineal foot, and 32,000 lbs. of moving and concentrated load. Additional provisions of the code deal with shear concentrations, and the effects of impact. The bridge must also exhibit sufficient stiffness to strictly limit deflections and oscillations, usually limited to a deflection-to-span ratio of 1 to 800 or less under full loading with impact. A large number of other provisions also exist for ensuring structural stability due to wind, ice, braking impacts and centrifugal effects.

In addition to the foregoing, a bridge must have a relatively long useful life, require only a minimum of maintenance, and have the ability to withstand climatic freeze/thaw cycles and the effects of deicing compounds used for maintenance of the trafficway.

Thus, although it is entirely possible to demonstrate that a typical bar joist commonly used in building construction to support an office floor or roof can serve as a bridgeway for pedestrians or light vehicular traffic, such a construction is in no way related to the service loading or structural requirements of a modern-day highway bridge.

To serve highway traffic needs, a number of bridge structures have evolved as standards. Although a large number of individual types of bridges exist, they can generally be put into a number of classes. One such class of prior bridge is a concrete bridge which can be either poured in place over removable forming or precast. Poured in place bridges generally require significant steel reinforcement, usually in the form of bars embedded in the concrete, and are typically limited to smaller spans. This is because as span length increases with this type of bridge, dead loads likewise increase dramatically. Precast concrete bridges generally consist of three basic forms, the precast tee, precast I girder and segmented box bridges.

Another broad classification of prior bridges is that of steel bridges. This classification includes the I beam bridge, typically used for spans of up to 70 feet. This type of bridge employs a multiplicity of cross braced I beams which are either brought into composite with the concrete bridge deck to improve performance in deflection, or in older bridges act as simple supports for the upper deck. Another type of steel bridge is the plate girder bridge, generally used for spans of from 50 through 120 feet. Plategirders are used in this construction in lieu of rolled beams to achieve the same results but with a deeper section formed by welding the girder web plate to flanges of required section. The orthotropic steel bridge is yet another steel bridge but is typically quite expensive because of fabrication and materials costs. This bridge achieves the requirements of structure through use of a double plated steel structure that distributes loads two ways across its steel decking. The steel truss bridge is another type of prior construction, but is seldom used today because of its expense, and depth-to-span ratio limit of about 1 to 10. A final type of steel bridge is the suspension bridge, which finds application only in extremely long spans.

As the above discussion demonstrates, a number of ways have been proposed in the past to resolve the structural problems inherent in highway bridge construction. The one constant factor present in these prior proposals however, is that the resultant bridge, in total cost, is very expensive. This expense generally arises because of a need for extensive, skilled on-site labor, or large quantities of expensive, especially designed and ordered steel structural members. Indeed, in a number of the bridge types discussed above, both of these problems are present.

SUMMARY OF THE INVENTION

The present invention overcomes the problems mentioned above, and provides a structurally superior bridge which in every way meets or exceeds existing safety standards and at a cost estimated to be significantly less than conventional bridge superstructures. In the bridge construction of the invention, use is made of standard structural plate steel and of shop casting techniques, which drastically reduce the need for skilled on-site construction labor.

Broadly speaking, bridges in accordance with the present invention are formed of interconnected, precast sections. Each such section includes a substantially planar permanent, structural metallic plate of length and width substantially equal to that of the desired section, with a layer of concrete composited to the plate. In a typical bridge section 8 feet in width and 60 feet long, a similarly dimensioned steel plate (preferably 5/16" thick self-rusting steel) is employed. A plurality of upstanding studs are secured, as by welding, to one face of the plate, and concrete is then poured over the plate to cover and embed the studs. Upon curing of the concrete, a mechanical bond between the concrete and plate is established, forming a unitized composite.

In preferred manufacturing procedures in accordance with the invention, all of the bridge span sections needed for a given bridge are cast simultaneously. This involves placing the necessary steel plates on a casting bed, followed by erection of recoverable forms and pouring of concrete thereover. Of course, where the preferred studs are employed as the compositing means, they are secured to the plates prior to application of concrete. The respective bridge sections are then transported to the erection site, hoisted into place on prepared bearings, and interconnected by welding of the respective plates together. The final steps in the bridge construction involve grouting between the bridge sections, and optionally applying a field topping thereon.

In other embodiments of the invention, the dead load of the ultimate bridge structure is lessened by means of elongated, light weight, high volume weight-reducing elements which are embedded into the concrete layer. Such elements may include hollow pipes or elongated, synthetic resin bodies. Steel mesh can likewise be embedded into the concrete for providing sufficient stability to the finished sections during transport and erection thereof. Finally, the bridges hereof are particularly suited for thermal deicing, by provision of an insulative barrier between the concrete and steel plate, and heating means embedded into the concrete.

DESCRIPTION OF THE PREFERRED EMBODIMENTS

Figure 8:
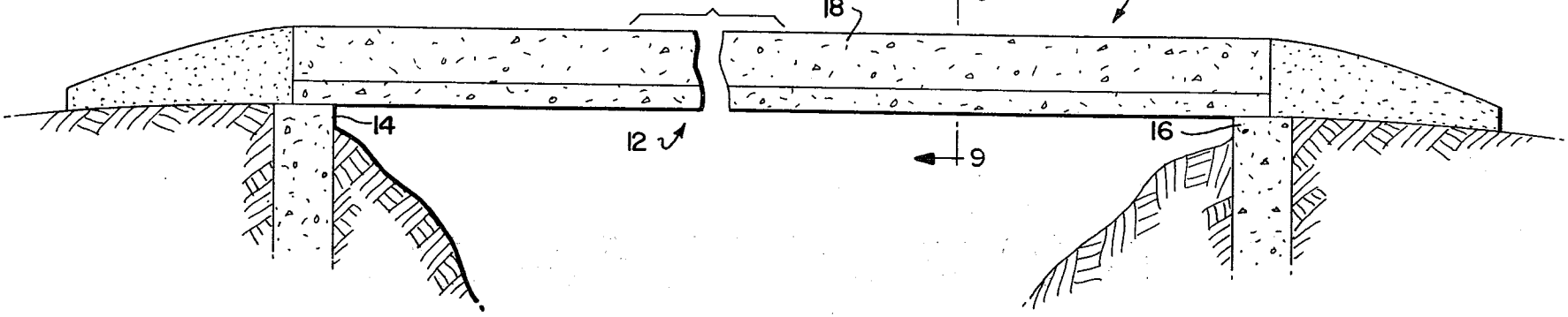
FIG. 8 is a fragmentary side elevational view of a completed bridge in accordance with the invention.
Figure 9:
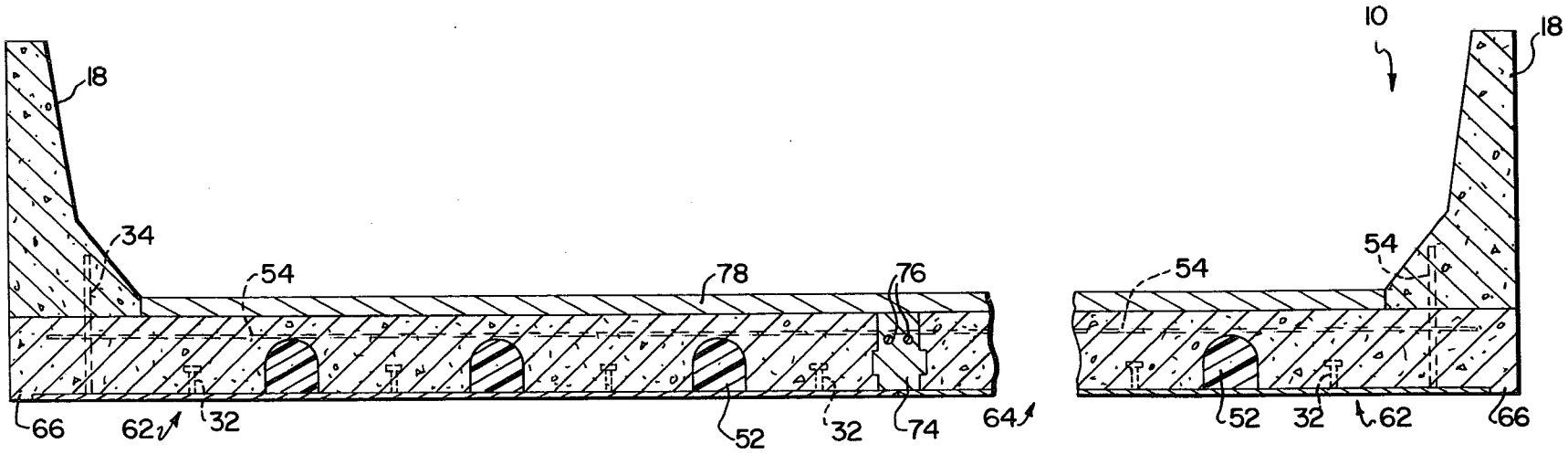
FIG. 9 is a fragmentary sectional view taken along line 9—9 of FIG. 8.

Turning now to the drawings, and particularly FIGS. 8–9, a completed bridge 10 in accordance with the invention is illustrated. Broadly speaking, the completed bridge 10 includes an elongated, spanning deck or superstructure 12 resting on and supported by bearings such as field cast concrete bearings 14 and 16, and a pair of spaced, marginal, upwardly extending guard rails such as cast rails 18 secured to and extending along the outermost margins of the deck 12. For purposes of discussion, a bridge in accordance with the invention having an overall width of 32 feet and a length of approximately 60 feet has been selected. While shorter or longer bridges can be produced, the bridge 10 is exemplary of the invention.

Figure 1:
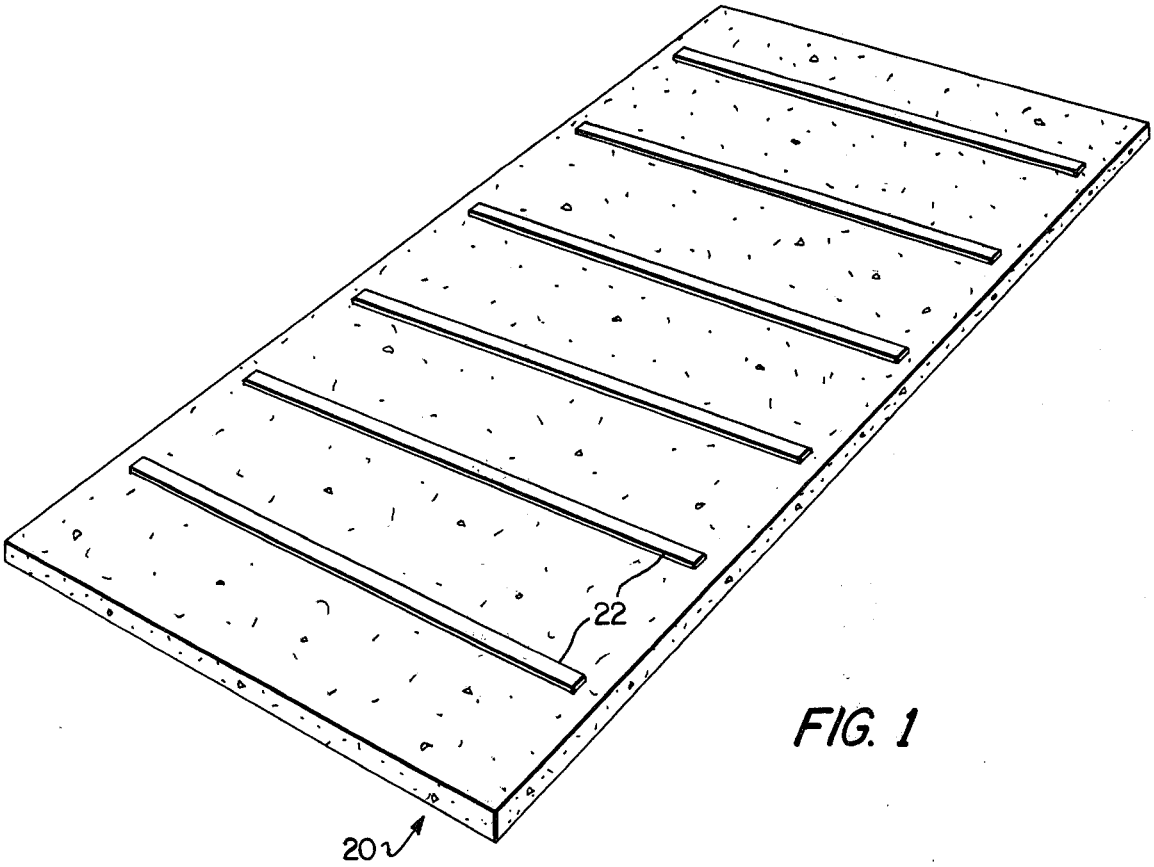
FIG. 1 is a perspective view of a casting bed used for forming the respective sections of a desired bridge.

The construction of bridge 10 is best understood by consideration of the method of manufacture and erection thereof. Generally speaking, deck 12 of bridge 10 is shop cast in regular sections of convenient length and width, and such sections are thereafter transported to the site, erected on prepared bearings, and interconnected as necessary. In more detail however, the fabrication technique is depicted in FIGS. 1–5, and attention is directed to these illustrations. In the first step of the fabrication, a reusable casting bed 20 of concrete or any suitable material is prepared which has length and width dimensions somewhat greater than those desired for the largest planned overall completed bridge. A series of elongated, transversely extending shim elements 22 are positioned in spaced relationship along the length of the bed 20. Although the scale of the FIG. 1 illustration does not admit of the detailed depiction of the elements 22, it is to be understood that the elements are configured with varying thicknesses along the length thereof and between respective elements for presenting a desirable camber, skew and crown in the final bridge. In short span bridges, the elements 22 may not be required.

Figure 2:
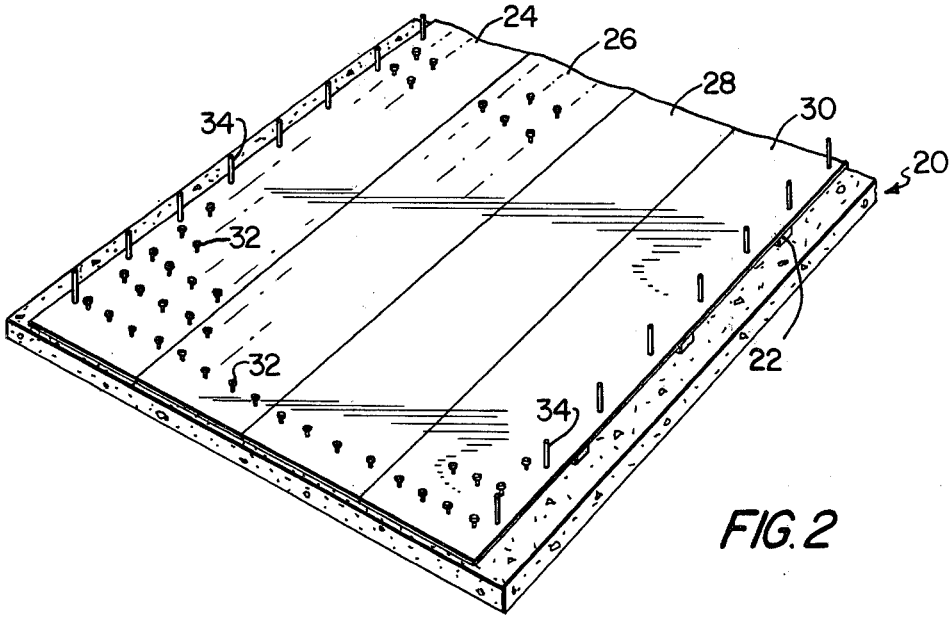
FIG. 2 is a fragmentary perspective view illustrating the placement of the plurality of juxtaposed metallic plates on the casting bed.

The next step in the fabrication method involves placement of substantially planar, structural metallic plates over the elements 22 and in side-by-side, abutting relationship so as to cooperatively defined a lowermost metallic substrate of length and width dimensions substantially similar to those of the final bridge. In the FIG. 2 illustration, four such plates 24, 26, 28 and 30 are placed on the elements 22. Plates in accordance with the invention normally have a width of at least 4 feet, more preferably from about 8 to 10 feet (because of shipping constraints). The length of the sections is preferably equal to the length of the bridge in question, so as to eliminate joints transverse to the direction of span (and thereby parallel to principal plate stresses). Obviously however, this may not always be possible. Each of the plates of the present embodiment is 8 feet in width and 60 feet in length, so that the final sections can be easily transported to the bridging site. Each of the plates is provided with a plurality of upstanding headed studs 32 welded to the upper faces thereof. Although not specifically depicted in FIG. 2, it will be understood that the studs 32 are provided over the entirety of the upper faces of the plates, up to 24 inches on center maximum spacing.

It will also be observed that the outermost plates 24, 30 are provided with a series of upwardly extending, spaced, threaded or plain bolts 34 which are located adjacent the outermost, elongated edges of the plate. The purpose of these bolts 34 will become apparent in the ensuing discussion.

The plates preferably have a thickness of at least about $\frac{1}{4}$ inch, and up to about $\frac{3}{8}$ inch, although thicker plates would be usable. For ease of maintenance, self-rusting steel such as Cor-Ten steel sold by the U.S. Steel Company is employed.

Figure 3:
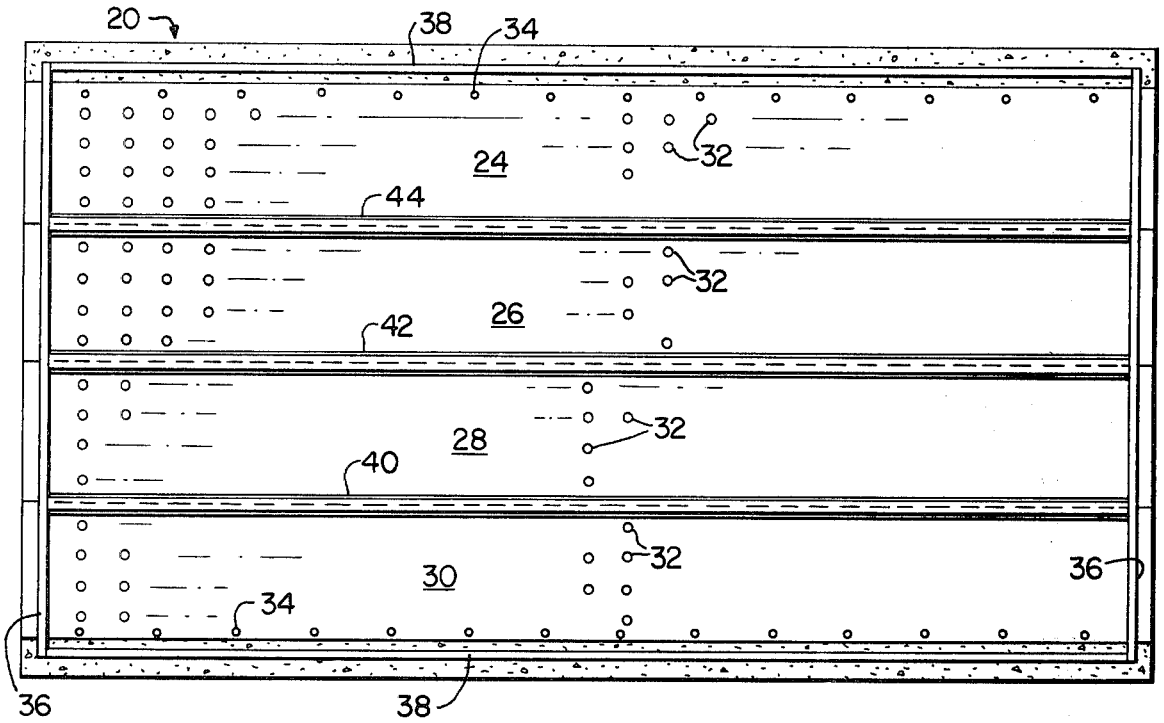
FIG. 3 is a plan view depicting the upright form walls positioned about the casting bed and steel plates.

Turning now to FIG. 3, the next step in the fabrication procedure is illustrated. Specifically, outermost and intermediate form walls have been erected about the plates 24–30 and the upstanding studs 32 thereon. Specifically, a pair of outer, spaced, transversely extending end walls 36 are provided, along with outer, spaced, elongated sidewalls 38. In the case of the end walls 36, it will be observed that the outermost margins of each of the plates extend beyond the walls 36. Sidewalls 38 however are spaced outwardly a short distance from the corresponding adjacent outer margins of the plates 24 and 30. Three intermediate form members 40, 42 and 44 are also provided and respectively extend between the end walls 36 in parallel relationship to the sidewalls 38. As best seen in FIG. 3, the member 40 extends along the length of and covers the joint between the plates 28 and 30; the member 42 extends along and covers the joint between the plates 26 and 28; and the member 44 extends along and covers the joint between the plates 24 and 26.

Figure 4:
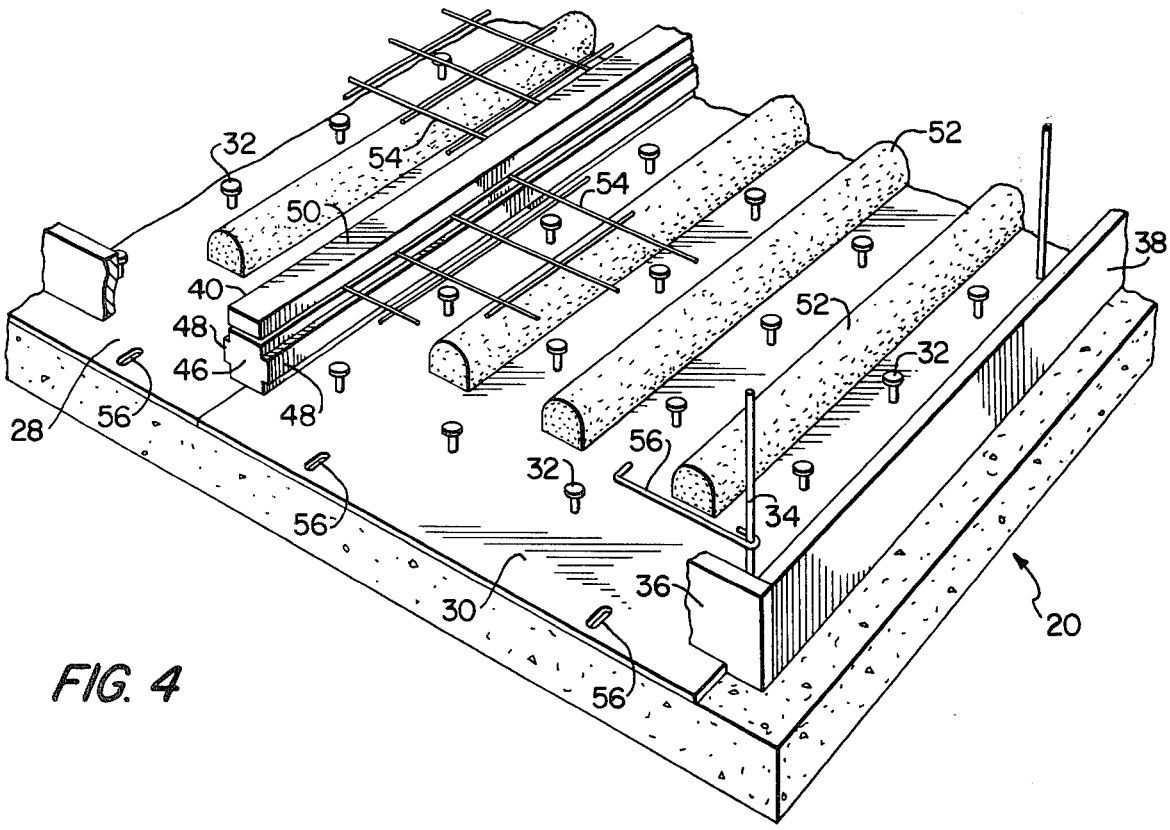
FIG. 4 is a fragmentary perspective view illustrating the casting bed, steel plates and form walls prior to pouring of concrete, and with the preferred void-creating synthetic resin elements and metallic mesh in place.

Referring to FIG. 4, it will be seen that the member 40 includes an elongated base section 46 which rests directly atop the joint between the plates 28, 30, and includes a pair of opposed, outwardly extending, rectangular projections 48 (which defined shearing keys in the final cast structure) along the length thereof. The member 40 further includes elongated, removable, rectangular in cross section top section 50 which rests atop base secton 46. The members 42 and 44 are identical to the member 40, and thus need not be further described.

FIG. 4 illustrates the condition of the casting bed just prior to concrete pour. Specifically, in the preferred form of the invention, a plurality of elongated, lightweight, high-volume weight-reducing elements 52 are positioned, usually by gluing or strapping, atop the plates 24–30 for creating void areas in the final bridge sections and thus reducing the dead weight of the final bridge. Preferably, the elements 52 are in the form of elongated, lightweight synthetic resin bodies having themselves substantial thermal insulative properties. The elements normally do not extend the full length of the underlying plate, but rather are longitudinally aligned and sectionalized and have therebetween corresponding pairs of reinforcing rods 53 (see FIG. 13). Respective sections of wire mesh 54 are placed within the form wall, with the innermost cut ends of the mesh 54 (as well as the tag ends of the bars 53) resting between the base and top sections of the separate intermediate form members 40, 42 and 44. Finally, reinforcing hooks 56 are positioned about each upstanding bolt 30, and are operatively interconnected to the mesh 54 for the purpose of rigidifying the upstanding bolts 34 in the final bridge construction. It will also be observed that each of the plates 24–30 is provided with a pair of spaced slots 56 therethrough in the regions thereof extending beyond the form walls 36. The function of these slots 56 will be explained hereinafter. Finally, in preferred forms of the invention, a coating of asphalt or other water and salt resistant mastic (not shown) is applied over the uppermost faces of the plates 24–30 prior to concrete pour.

The next step involves pouring of concrete into the described form structure and onto the underlying plate. In such pour, it will be understood that the studs 32, elements 52, wire mesh 54, rods 43 and reinforcing hooks 56 are embedded in concrete; the level of concrete pour is normally coincident with the upper surface of the top sections 50 of the intermediate form members. Generally speaking, the concrete layers should be dimensioned for a minimum centerspan thickness to span length ratio of about 1:32, including field topping if structural.

Figure 5:
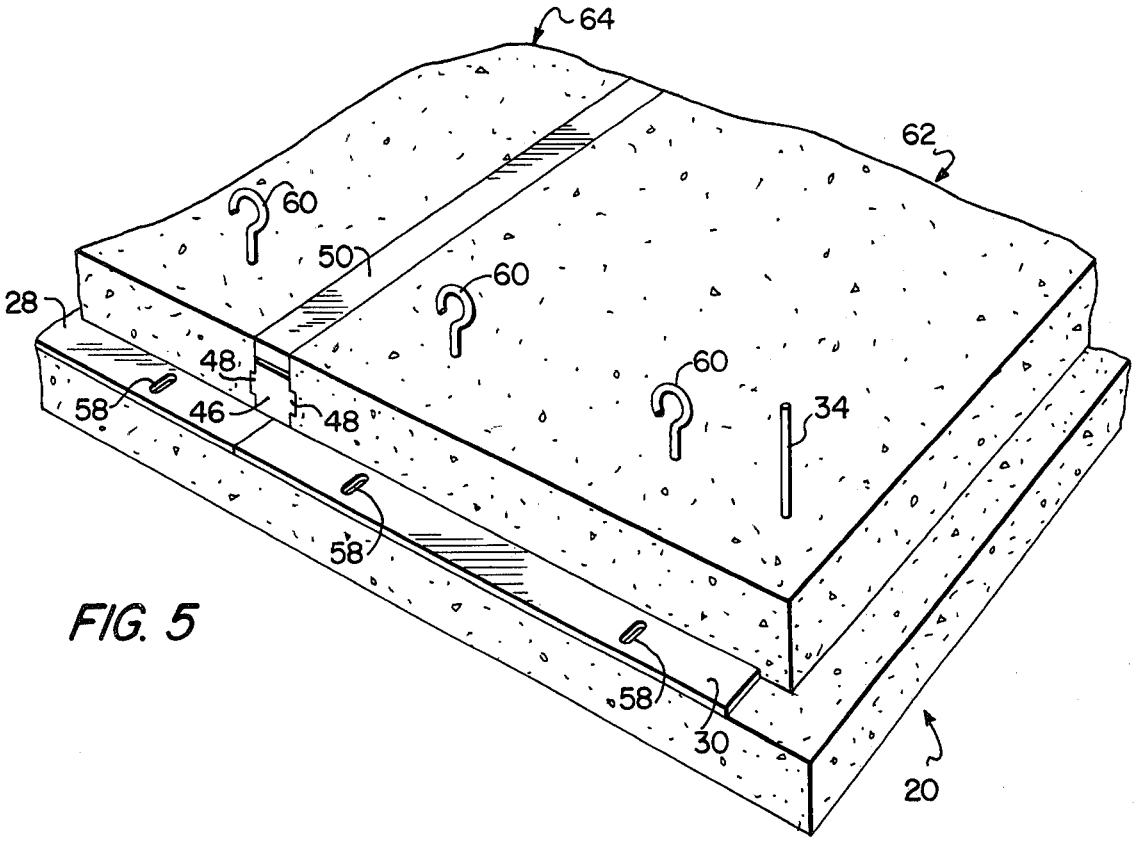
FIG. 5 is a fragmentary perspective view of completed bridge sections on the casting bed, with certain of the form walls removed.

After pouring, the concrete is allowed to cure in the normal or accelerated rate. During the curing process however, grapple hooks 60 as needed are embedded into the concrete in order to facilitate movement of the completed bridge sections (see FIG. 5) FIG. 5 illustrates the bridge sections after concrete cure and removal of the outermost form walls 36, 38. That is to say, a layer of concrete is applied over and deposited to each of the plates 24–30 to form a pair of identical, outermost sections 62 and another pair of identical, innermost sections 64. It will be observed in this respect that each outer section 62 includes an elongated, marginal, concrete drip edge 66 which covers and protects the outermost edges of the corresponding plates 24, 30. Further, it is known that the preferred self-rusting steel plates stain if contacted by water, and the runoff therefrom will discolor underlying structures; the edges 66 prevent this by establishing a runoff barrier for rainwater and the like. Further, it will be understood from the foregoing discussion that the inner elongated sidewalls of the sections 62, 64 will present a series of short, outwardly projecting stub ends of the embedded wire mesh sections 54 and rods 53. Such ends are obscured in FIG. 5 by virtue of top section 50.

Figure 7:
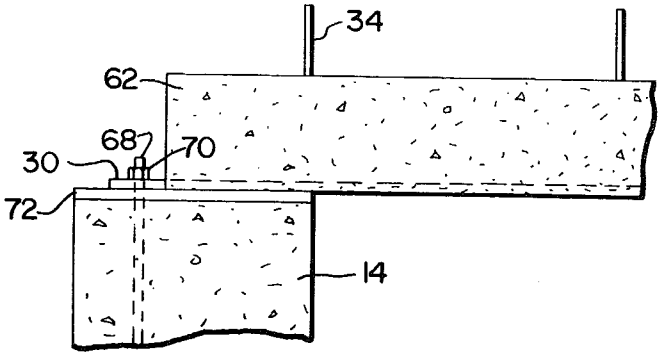
FIG. 7 is an enlarged, fragmentary side elevational view illustrating a bearing support connection.

After the respective sections 62, 64 have been cast as described, they are separated from one another as unitary, composited bridge sections, and are transported to the bridging site. At this point the sections are individually placed on the prepared bearings 14, 16 in spanning relationship thereto. Interconnection between the sections and the underlying bearings (FIG. 7) is effected by means of upstanding bolts 68 operatively connected to the bearing supports; such bolts extend through the slots 58 in the plates 24–30, and nuts 70 are employed to securely connect the sections thereto. A resilient bearing pad 72 is normally interposed between the upper surfaces of the bearings, and the undersides of the metallic plates. It will be understood that the slots 58 allow for thermal expansion and construction of the overall bridge 10.

Figure 13:
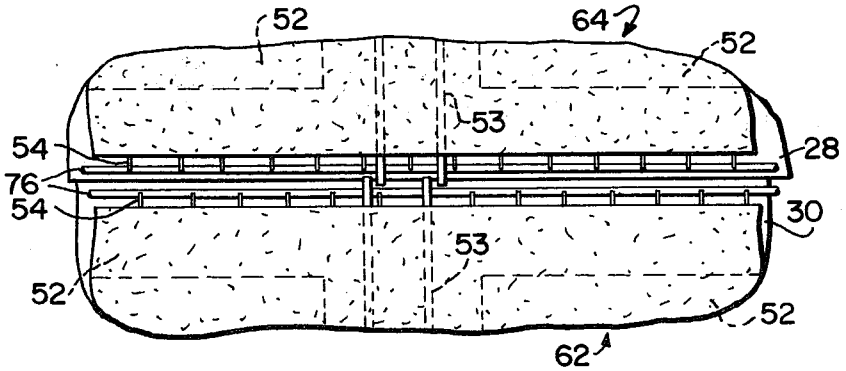
FIG. 13 is a fragmentary top view illustrating two side-by-side bridge sections after welding of the respective underlying plates thereof together, but before grouting of the joint therebetween.

After the sections 62, 64 have been positioned on the bearing supports, the sections are interconnected. Inasmuch as all of the bridge sections were cast simultaneously with the respective underlying plates in side-by-side abutting engagement, it will be understood that when the sections are initially positioned, the plates will again be in this orientation. Furthermore, the elongated joint presented by the abutting sections are open, inasmuch as a space, occupied during the forming process by the members 40, 42 and 44, is open. This joint is typically from about 6 to 12 inches wide. The appearance of an elongated joint between respective sections is illustrated in FIG. 13. In this view, it will be seen that the plates 28, 30, abut, and that the tag ends of the mesh sections 54 extend outwardly and lie within the joint. Also, it will be observed that the tag ends of the cross bars 53 between respective aligned pairs of elements 52 likewise extend into the open joint.

The first step in the interconnection procedure involves stitch welding of the plates together along the elongated joint presented thereby. This can be done from above, through the open joint. Following such welding, grouting 74 is placed in the open joint to fill the latter. Referring to FIG. 9, it will be seen that the elongated shearing keys formed in the respective concrete layers by the projections 48 of the members 40, 42 and 44 serve to assist retention of the grout 74 within the joints. Also, in some forms of the invention (particularly in multiple span constructions), a pair of elongated reinforcing bars 76 are embedded within the grouting 74 to further strengthen the joint. The bars can of course be post-tensioned if desired, and in multiple span bridges serve to establish structural continuity between spans.

When the grouting of the three joints of bridge 10 is completed, the elongated side rails 18 (which are preferably of precast, sectionalized structure) are secured to the deck 12. To this end, the sections of each guardrail 18 are provided with apertures for receiving the upstanding bolts 34, and nuts or epoxy are employed to securely fasten the guardrail sections to the underlying deck 12. At this point, if desired, a field topping 78 may be applied over the interconnected sections 62, 64 in order to complete the overall bridge 10.

Figure 10:
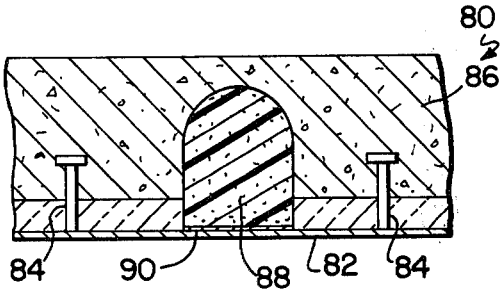
FIG. 10 is a fragmentary vertical sectional view illustrating a thermally insulated bridge section in accordance with the invention.
Figure 11:
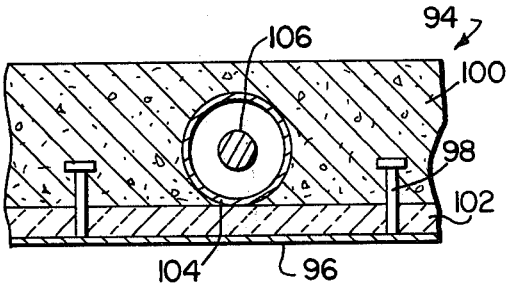
FIG. 11 is a fragmentary vertical sectional view illustrating another embodiment of a thermally insulated bridge section.
Figure 12:
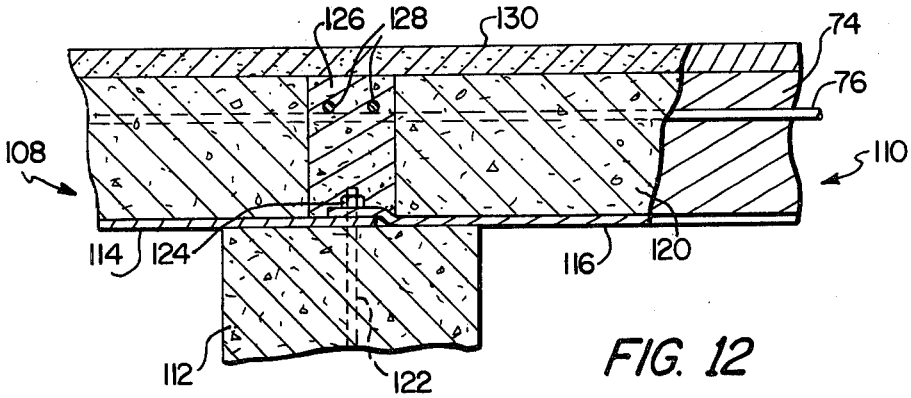
FIG. 12 is a fragmentary vertical sectional view illustrating the connection of two bridge sections in midspan, with a bearing supporting the interconnected sections.
Figure 6:
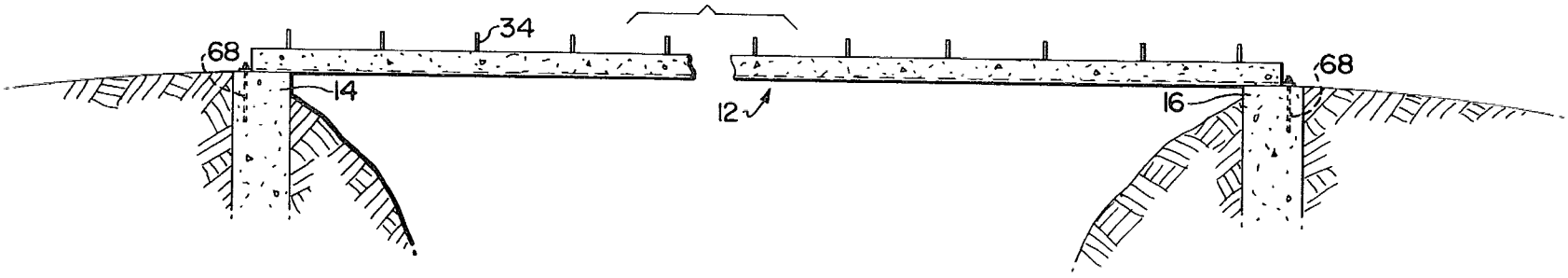
FIG. 6 is a fragmentary side elevational view illustratng the multiple-section bridge in place on bearing supports therefor during bridge construction.

Turning now to FIGS. 10–12, certain other embodiments in accordance with the invention are depicted. First of all, in FIG. 10 an insulated bridge section 80 is illustrated in fragmentary section. The bridge section 80 includes the structural, metallic, substantially planar lowermost plate 82, upstanding studs 84 welded to the upper face of plate 82, and a layer of concrete 86 composited to plate 82 by means of the studs 84. A synthetic resin weight reducing element 88 is also depicted, which in this instance is secured to plate 82 by means of glue 90. The element 88 is formed of thermally insulative synthetic resin material, similar to the elements 52 described above. However, in the FIG. 10 embodiment a separate, synthetic resin layer 92 of thermally insulative material is interposed between the uppermost face of plate 82 and the concrete layer 86 and between the elements 88. In this way the underside of the bridge presents a substantial insulative barrier, and hence characteristic icing of the bridge during wintertime conditions is lessened.

FIG. 11 is similar to FIG. 10 and shows a bridge section 94 having an underlying planar plate 96, upstanding compositing studs 98, a layer of concrete 100, and a thermally insulating layer 102 between the plate and concrete. In this instance however, in lieu of the synthetic resin weight reducing elements 88, tubular members 104 are provided which are embedded within the layer 100. It will be appreciated that the tubular members 104 define voids within the concrete layer for weight reduction. Also, in the FIG. 11 embodiment, a schematically illustrated heating element 106 is illustrated within the member 104. The heating element 106 may be in the form of a high capacity electrical resistance wire, or may be a central pipe for conveying steam or other heating fluid. In any event, the function of the element 106 is to heat the concrete layer 100 for deicing purposes during wintertime. Heating costs are minimized with the FIG. 11 construction, inasmuch as the insulative layer 102 prevents substantial heat loss through the underside of the bridge structure. Hence, with the bridges of the present invention, deicing becomes a practical alternative.

Finally, FIG. 12 illustrates a situation wherein two end-to-end abutting sections 108 and 110 are interconnected in mid span and supported by a central bearing support 112. Each section includes lowermost metallic plate 114 or 116, and a layer of concrete 118, 120 composited to the corresponding plate. At the point of interconnection of the sections 108, 110 the apertured, outwardly extending ends of the plates thereof are both slipped over upstanding connection bolts 122 embedded in support 112, and nuts 124 are employed to interconnect the sections. Grouting 126, preferably with reinforcing bars 128 embedded therein, fills the void between the ends of the respective sections 108, 110. Finally, a field topping 130 is applied over both of the sections, only if required, to complete the construction.

As indicated previously, a prime feature of the present invention pertains to the structural compositing between the underlying plates of the bridge sections, and the corresponding concrete layers. Preferably, such compositing is achieved through use of the upstanding welded studs, although there are other possibilities. The compositing of the metal and concrete should be such that, when the sections are supported for bridging purposes, the plate absorbs tensile forces imposed on the structure both parallel and transverse to the direction of span. Correspondingly, the concrete layer absorbs compressive forces both parallel and transverse to the direction of span. The importance of compositing becomes apparent when it is realized that the substantially planar metallic plates used in the invention are themselves incapable of spanning; likewise, concrete, although possessing substantial strength in compression, has very little strength in tension, and cannot be realistically used alone for spanning purposes. Thus, the structure of the present invention becomes viable only upon compositing of the metallic plate and concrete layer; but when this is done, a significantly improved structure results. In fact, the structural integrity of bridges in accordance with the invention is such that very low depth-to-span ratios can be employed, and this in turn lowers the dead weight of the bridge structure, thus reducing costs and the need for extensive supports. Also, the preferred construction of the invention is designed to distribute loads over large areas of concrete, and this minimizes the need for shear reinforcements in the concrete for absorbing diagonal tension forces at the bearing areas. Such reinforcements are common in most prior precast systems.

Apart from the structural advantages achieved through use of the invention, the total cost of bridges in accordance therewith is substantially reduced. There are a number of reasons for this result. First, the materials used are all standard items not requiring custom manufacture. For example, the steel plate employed in the invention can be ordered in quantity from the mill, inasmuch as the plate width and thickness will normally be the same for all spans from about 10 to 70 feet. This eliminates the need to purchase specialty steel shapes from warehousemen, and results in approximately a 30% savings in steel costs. Further, the concrete employed is of course a standard, relatively low cost item, even if it is desired to use lightweight concrete. Finally, because the metallic plate structure can distribute tensile loads bidirectionally, need for conventional, hand placed two-way heavy reinforcing mats (which in some cases must be epoxy clad for resistance to salt corrosion) is minimized or eliminated. (The mesh 54 described above are primarily employed for maintaining the integrity of the respective sections during transport; they are not reinforcing bars of the conventional variety).

Another factor which greatly influences the overall cost of bridges in accordance with the invention is the fact that skilled on-site labor is drastically reduced. That is to say, with the methods of the invention a given bridge is shop cast using factory labor and simple, essentially universal, reusable forming structure, all of which makes mass production a viable proposition. This in sharp contrast to present precast systems where any alterations from a standard construction requires expensive new forming. Further, factory conditions make feasible use of light or heavyweight concretes which are difficult or impossible to apply in the field. In the case of lightweight concrete, such use is also advanced because the material can be embedded within the bridge structure and protected from the effects of the elements.

Thus, use of extensive quantities of steel plate, which at first blush appears to be a profligate waste of materials, in fact yields a number of highly significant advantages, both structurally and from a cost standpoint, in the invention.

Among other advantages of the present invention are the following. First, because the system is not pretensioned, camber and seam matches can be closely controlled, and this results in a structure that can be finish grouted after erection without the need for a field topping. Although in many instances such a topping is used with the present invention, it is not an absolute requirement, as in the case of most presently known precasting systems. Second, the thickness of the precast deck structure allows for shop installation of full depth connections for railings and special features without the rather extensive reinforcements required by thinner decking systems. Finally, the use of the preferred self-rusting steel for the bottom plates greatly reduces maintenance costs and increases the useful life of the bridge structure. It will also be appreciated that the relatively flat underside of the decking structure in accordance with the invention allows use of the most simple, flat-topped economic bearing supports and simplifies erection of the bridge.

The fact that, in preferred forms of the invention, there are no joints transverse to the direction of span and between bearing supports minimizes problems of fracture and fatigue commonly encountered in welded or bolted joints.

Having thus described the invention, what is claimed as new and desired to be secured by Letters Patent is:

1. A bridge section of desired length and width, comprising:

a pair of separate, spaced apart bearing supports;

a composite deck spanning said bearing supports and being supported by the same, said deck including a substantially planar structural metallic plate presenting generally flat, opposed upper and lower faces and having a thickness of at least about ¼ inch, said plate being longer than it is wide, and having length and width dimensions substantially similar to that of said desired length and width;

a plurality of separate force-transmitting elements each including an upstanding portion and mechnical interlock structure at the upper end of the portion;

respective force-transmitting welds securing the lower ends of said upstanding portions to the upper face of said plate; and a layer of concrete over said plate and having length and width dimensions substantially similar to those of said plate, at least a portion of said upstanding element portions and said interlock structures being embedded within said concrete layer, said concrete layer being of a thickness such that the vertical distance from the upper ends of said elements to the upper surface of said concrete layer remote from said plate is greater than the vertical height of said elements, said deck being self-supporting in span between said bearing supports.

2. The section as set forth in claim 1 wherein said plate is about five-sixteenths inch in thickness.

3. The section as set forth in claim 1 wherein said plate is formed of self-rusting steel.

4. The section as set forth on claim 1 wherein said concrete layer is dimensioned for a minimum center-span thickness to span length ratio of about 1:32.

5. The section as set forth in claim 1 including a plurality of lightweight, high volume weight-reducing elements embedded in said concrete layer.

6. The section as set forth in claim 1 including a layer of thermal insulation between said concrete layer and plate.

7. The section as set forth in claim 1 including wire mesh embedded in said concrete layer.

8. The section as set forth in claim 1 including heating means within said concrete layer.

9. The section as set forth in claim 1 wherein said plate has a width of at least about 4 feet.

10. The section as set forth in claim 1 wherein said plate has a width of from about 8 to 10 feet.

* * * * *